United States Patent [19]

Eriksson

[11] Patent Number: 4,711,162

[45] Date of Patent: Dec. 8, 1987

[54] METHOD OF VENTILATING ROOMS

[75] Inventor: Mats Eriksson, Ski, Norway

[73] Assignee: Flakt, AB, Stockholm, Sweden

[21] Appl. No.: 878,375

[22] PCT Filed: Oct. 28, 1985

[86] PCT No.: PCT/NO85/00069

§ 371 Date: Jun. 11, 1986

§ 102(e) Date: Jun. 11, 1986

[87] PCT Pub. No.: WO86/02710

PCT Pub. Date: May 9, 1986

[30] Foreign Application Priority Data

Oct. 30, 1984 [NO] Norway ..... 844320

[51] Int. Cl.[4] ..... F24F 13/04

[52] U.S. Cl. ..... 98/38.3; 98/38.1

[58] Field of Search ..... 98/38.1, 38.3, 38.2; 165/123

[56] References Cited

U.S. PATENT DOCUMENTS 3,032,323 5/1962 Church ..... 98/38.3 X

FOREIGN PATENT DOCUMENTS 2262009 6/1974 Fed. Rep. of Germany ..... 98/38.3

*Primary Examiner*—Harold Joyce

*Attorney, Agent, or Firm*—Scully, Scott, Murphy & Presser

[57] ABSTRACT

In a method of ventilating rooms, fresh air is introduced into the room at one or several places at floor level by means of diffuse air supply, and the room air is exhausted at the ceiling level of the room. One or several jets of fresh air (*2a, 2b*) are blown at high velocity into an induction chamber (4) thereby sucking surrounding air (3) into the induction chamber and becoming mixed therein with the surrounding air sucked into the induction chamber. The mixed air from the induction chamber (4) is introduced essentially horizontally into the room to be ventilated. Into the induction chamber (4) surrounding air is sucked in which consists of air (3) from the room to be ventilated, this air being sucked into the induction chamber from a level in the room which is higher than the level at which the mixed air is introduced into the room. The mixed air is introduced into the room by means of diffuse air supply.

7 Claims, 3 Drawing Figures

HEIGHT OF ROOM IN METERS.
3
2
1
NO ADMIXTURE
r2 = 10
r2 = 15
r2 = 20
INTAKE LEVEL OF ROOM AIR.
10
20
30
40
50
100
RELATIVE CONCENTRATION OF CONTAMINANTS , r3,
IN INTRODUCED VENTILATION AIR AT FLOOR LEVEL.

METHOD OF VENTILATING ROOMS

The present invention relates to ventilation of rooms based upon the principle of supply of air by means of the parallel -flow system ("diffuse air supply") to the zones of the room which are occupied or will be occupied by persons.

THE PRIOR ART

A good ventilation system is distinguished thereby that it rapidly carries away the contaminants, i.e. that the time the contaminants are present in the room shall be as short as possible.

The main tasks of the ventilation are to supply the amount of oxygen necessary for the breathing and to keep the concentrations of contaminants sufficiently low. Heat generation may often be considered to be a contaminant, and it is then one of tasks of the ventilation to remove undesired heat.

In order to master these tasks a general ventilation and, very often, a supplemental ventilation are used in offices, in industry and in dwellings. The most usual supplemental ventilation within the industry and in dwellings is a point exhaust at the source of contamination, e.g. the kitchen stove. The general ventilation shall partly provide supply of oxygen and partly control the levels of contaminations from more "diffuse" sources. Examples of such sources are contaminations originating from people and from building materials. The exhaust, e.g. the kitchen stove hood, at the source of contamination is intended to take care of the contaminants directly at the source. The general ventilation and the point exhaust are differently designed, however, they have the same primary task , viz. to remove contaminants.

The way in which the supplied ventilation air is distributed in the room is one of the most important variables influencing upon the air quaility in the room. It has been found that the best air distribution is obtained by so called "piston flow". This means that the air, similarly to a piston, pushes the contaminants ahead of itself. This distribution of air yields the most rapid removal of contaminants from the room, see Environmental International, 8, p. 000–000, 1982, "Efficient Ventilation in Office Rooms" by Tor-Göran Malmström and Anders Ahlgren, and "Indoor Air, Buildings, Ventilation and Thermal Climate", the third international conference on "Indoor Air Quality and Climate", held in Stockholm Aug. 20–24 1984, pages 59–64, the article by Mats Sandberg and Mats Sjöberg.

The so called complete mixing ventilation yields a complete spreading of the contaminants, which is undesirable in many instances. However, the complete mixing ventilation is the predominantly used ventilation principle with supply of ventilation air through the ceiling, the walls and/or the floor of the room and exhausting the room air through the ceiling, the walls and/or the floor. The ventilation air or the air supplied is traditionally blown into the room by means of fans and a system of ducts, and it is aimed at a very rapid mixing of the air in the room, whereby the room temperature from the floor to the ceiling will be esentially the same at all levels, and the concentration of contaminants in the room air will similarly be constant at all levels in the room.

Ventilation by mixing will under certain operational conditions not lead to a complete mixing, e.g. as when the air supplied has superior temperature and both the means for supplying the air and the means for exhausting the air are arranged at the level of the ceiling. A short-circuit flow may then arise, and only a limited part of the air supplied will be utilized for ventilating the room, i.e. the ventilation efficiency becomes low.

The way in which the ventilation air is introduced into the room and the consequential distribution of the air in the room are, accordingly, decisive variables for the ability of a ventilation system to remove air-born contaminants in the air within the room. Further, the localization of the means for supplying the ventilation air and the means for exhausting the air is of essential importance to the ventilation effect obtained, and it has recently been shown that a so called floor-ceiling system according to which the ventilation air is introduced approximately at floor level and the exhaust air is removed at ceiling level renders a very rapid carrying away of air-born contaminants in the room. Accordingly, the floor-ceiling system is currently considered the most interesting solution for ventilation, and this system has been further improved by being based upon the principle of so called "diffuse" or "displacement" supply to the room of air having lower temperature than the air within the room.

For practising the displacement air supply with parallel flow diffusers for the ventilation diffusers are arranged at floor level, and the diffuser or the diffuser valve which is used is generally a device through which the supplied air may "diffuse", e.g. a filtering mat or a perforated plate. One single perforated plate will as a rule lead to various types of oblique flow of the ventilation air and cannot be recommended as means for supplying the ventilation air. However, the use of perforated plates in the front of the diffuser combined with a more air guiding and air distributing structure has given a relatively uniform flow of air into the room. Filter-mats or other types of porous plates yield a very uniform flow of the ventilation air and are well suited for supplying air having the same temperature as the air within the room.

However, if the air supplied becomes colder by more than about 2° C. compared with the air within the room, the so called cold slide effect may start to become substantial. The air supplied will enter the room through the diffuser with a horizontal and vertical velocity component, and the air velocity at ankle level may then rapidly increase to above 0.2 m/sec. which is normally considered to be the upper limit if feeling of draft is to be avoided. However, more recent research investigating the variation in air velocity level to which persons are exposed by mixing ventilation and by displacement ventilation respectively has shown that an air velocity at ankle level of up to 0.3 m/sec. may be tolerated.

When performing ventilation by means of diffuse air supply, air will be conveyed from the lower part of the room and up towards the ceiling by convection flows. Zones of stratification will then be formed in the room, i.e. a lower zone of fresh air and an upper contaminated zone. The ventilation air is supplied at a temperature which is slightly lower compared with the temperature of the air within the room, and the ventilation air becomes distributed along the floor and in the lower part of the room. The size of the fresh air zone and of the contaminated zone will be dependent upon the convection flows which are generated due to the heat sources in the room. The contaminants are normally supplied to the room at one or more heat sources in the room, and in this manner by means of diffuse air supply at low level in the room the contaminants will be conveyed up to the upper part of the room and become stored therein, and when using the floor-ceiling system the contaminated air in the upper zone will be exhausted through the ceiling, and there is obtained a zone for occupation by persons which has far more comfortable air than the air in which persons must stay when using the so called mixing ventilation. The diffuse air supply causes, as indicated above, a displacement ventilation, and measurements which have been carried out in the laboratory indicates that the air quality becomes between 5 and 10 times better using this ventilation principle than when using conventional mixing ventilation, which means that contaminants from human beings in the occupied zones then will become between 10 and 20% of the concentration of contaminants which would have existed when using mixing ventilation, see the above-mentioned reference to "Indoor Air, Buildings, Ventilation and Thermal Climate" and idem. the article by Gaute Flatheim "Airconditioning Without Draft and Noise", p. 171–177. However, there is a lower limit for the amount of air supplied per source of convection streams. If the amount of air supplied is far to small, the risk exists that the air will only be supplied to the lower part of the convection stream so that the contaminants will accumulate in the air from the waist level of the person and upwards. However, the air quality obtained using displacement ventilation with diffuse air supply will always be better than the air quality which is obtained with a traditional mixing system for the same amount of air and the same amount of contaminants.

By displacement ventilation with diffuse air supply with introduction of air of lower temperature than room temperature, the air temperature in the room will increase approximately linearly from floor to ceiling. The temperature at the floor will lie between the exhaust temperature and the temperature of the supplied air. Using supply elements by means of which the air is laminarily supplied, e.g. filter cloths, the temperature at the floor will be very close to the temperature of the air supplied also at large distances from the point of supply whereas use of end elements causing turbulence, like e.g. perforated plates, will influence the temperature at floor level which with increasing degree of turbulence will become more and more close to the exhaust temperature. A conventional solution is to select the degree of perforation of the plates in such a way that the floor temperature will lie approximately in the middle between the exhaust temperature and the temperature of the air supplied. In contrast thereto, when using conventional mixing ventilation, the temperature will, as mentioned, at any place in the room be the same as in the exhaust. Accordingly, the temperature in the occupation zone will become lower using diffuse air supply than when using mixing ventilation when these two systems are compared for the same temperature of the air supplied, the same heat load and the same amount of air. Usually, this temperature difference will be about 3° C. In order to obtain a certain air temperature in the occupation zones, the temperature of the air supplied must, accordingly, be about 3° C. lower when using mixing ventilation than when using displacement ventilation with diffuse air supply. Accordingly, there exists a lesser demand for mechanical cooling of the ventilation air when displacement ventilation with diffuse air supply is used. If only free cooling of the air supplied exists, this means that the desired air temperature in the occupation zones will be obtained during a larger period of the time the zones are occupied when using displacement ventilation with diffuse air supply than when using conventional mixing ventilation.

When the difference between the exhaust temperature and the temperature of the supplied air increases, there will, due to the aporoximate linear increase of the air temperature from floor to ceiling, also become a greater difference between the air temperature at head level and the air temperature at floor level. Standards recommend that the temperature difference between head and feet is not to exceed 3° C. for sitting persons. This restricts the possibility of supplying cooling effect to the room by the use of air as medium. The cooling effect is equal to the amount of air times the specific heat constant times the temperature difference (room air minus supplied air), viz. $P = m \cdot c_p \cdot \Delta t$.

The actual construction of the supply unit greatly influences the possibility of supplying air having substantial under-temperature. When using filter cloth as air supply element the temperature difference must be restricted to about 2° C., whereas when using a favourable design for the air supply element using perforated plates as end element, the temperature difference may be about 7° C.

The outlet velocity of the air supplied when using diffuse air supply must be low because the principle underlying the whole technique is based on the creation of the least possible movement in the room air. Further, the places of work will be situated near the units for the supply of air, and because it is desired that the air velocity of the air supplied at ankle level is not to exceed 0.2 m/s in order to avoid feeling of draft, in practice it can rarely be permitted that this so called proximity zone with respect to the supply units extends more than from 60 to 80 cm into the room.

The supply unit or the supply units ought to be so constructed that air having a highest possible $\Delta t$ compared with the room temperature may be supplied to the room without creating draft along the floor. If sufficient cooling effect cannot be supplied to the room by means of the ventilation air, separate installations must be arranged for this purpose, and this very often demands high costs and leads to increased maintenance costs.

It has been shown above that for a given amount of air and for a given heat load in the room, the temperature of the air supplied must be about 3° C. colder when using conventional mixing ventilation than when using displacement ventilation. Further, the displacement ventilation will more rapidly remove air-born contaminants and create stratification or formation of zones in the room, with a lower zone having a very low concentration of contaminants and with an upper zone having a concentration of contaminants which normally corresponds to the concentration of contaminants when using mixing ventilation. However, as mentioned, the principle of displacement ventilation has its restrictions thereby that (a) warm air cannot be supplied when efficient ventilation is desired
(b) the cooling effect supplied is restricted due to the risk of draft along the floor
(c) the cooling effect supplied is restricted due to risk of too large temperature differences between feet and head.

The object of the invention

It is the object of the invention to provide an improved method of ventilation using diffuse air supply (displacement ventilation) with increased field of use due to (a) reduced risk of draft along the floor
(b) reduced temperature differences feet-head
(c) improved cost of operation
(d) reduced investment costs.

SUMMARY OF THE INVENTION

Thus, the invention relates to a method of ventilating rooms, wherein one or several jets of fresh air at high velocity are blown into an induction chamber and suck surrounding air into the induction chamber and in the induction chamber are mixed with the surrounding air sucked in, and wherein the air mixture from the induction chamber is introduced substantially horizontally into the room to be ventilated. The present method is characterized in that into the induction chamber surrounding air is sucked in which is constituted by room air which is taken from a higher level in the room than the level at which the air mixture is introduced into the room, the air mixture being introduced into the room by means of diffuse air supply.

The present method which may be said to be based on a controlled principle of induction, offers the advantage that the fresh air which is introduced into the room in admixture with room air may have a lower temperature compared with the room air without causing the cold slide effect and the consequential feeling of draft, thereby that the fresh air is mixed with room air which has been taken from a lower zone of relatively pure air in the room and which has a higher temperature than the fresh air, and the air mixture may then from the induction chamber be introduced into the room at a temperature which makes it possible to avoid the cold slide effect which would else have been caused if the fresh air had not previously been mixed with some of the room air. By the controlled mixture of fresh air and the relatively pure room air, the air mixture which is introduced into the room will have a temperature which is close to the room temperature. Accordingly, the temperature difference feet-head will then be reduced.

By means of the present admixture of room air from the lower relatively pure zone in a room with fresh air which is supplied to one or more diffuser means, there will be demand for a reduced supply of fresh air in order to introduce the same cooling effect into the room. This causes a reduction of the energy consumption of the fresh air fan. The energy consumption decreases proportionally with decreasing amount of transported air. Further, the cross-sectional area of the channels for the supply of fresh air can be reduced. Thus, there will be obtained a reduced energy consumption and a reduced space demand for the ventilation plant in the building, and thus, the present admixture of room air with the fresh air supplied by means of diffuse air supply to the room offers substantial technological and economical advantages.

The principle of induction is not novel per se. Thus, U.S. patent specification No. 2,613,587 discloses a diffuser for supplying warm air to a room in admixture with a larger amount of more cool air which has been drawn in from the room. Accordingly, the diffuser is not to provide for ventilation of the room but for heating the room, which is the opposite of the case when ventilating rooms by means of diffuse air supply where the air introduced has a lower temperature than the air in the room. Further, according to the US patent specification, room air is sucked into an induction chamber, and the air mixture is blown out of the induction chamber at a higher level in the room, and the diffuser may then not be used for maintaining the advantages of diffuse air supply, the more so as the diffuser, as mentioned, is designed for heating a room and not for ventilating a room.

U.S. patent specification No. 2,663,244 relates to a device for introducing temperature conditioned air into a room, and it appears particularly clearly from FIG. 1 and FIG. 2 of the patent specification that conditioned air is introduced through the bottom of an induction chamber, that air from the room is thereby sucked into the induction chamber from the floor level of the room, and that the mixed air is introduced into the room at a higher level than the level at which the room air is sucked into the induction chamber. Accordingly, the advantages of diffuse air supply may neither be obtained when using the device disclosed in U.S. patent specification No. 2,663,244.

British patent specification No. 892,174 relates to a ventilating arrangement for buildings, especially for greenhouses, and the invention according to the British patent specification comprises an induction principle whereby water jets are sprayed into an induction chamber which suck fresh air into the chamber through an opening. Air from the room to be ventilated is sucked into the induction chamber and therein mixed with fresh air, and the air mixture is introduced into the room to be ventilated through an air supply opening. This is a system which is clearly different from the system which is used in carrying out the method according to the present invention, where the fresh air itself is used in order to provide the jets for sucking into the induction chamber air from the room to be ventilated. It is neither disclosed in the British patent specification that the air mixture is to be introduced from the induction chamber by means of diffuse air supply into the room to be ventilated.

British patent application No. 2,127,145A discloses air induction ventilators, where an apparatus for ventilating a space comprises an induction chamber having an inlet open to ambient atmosphere, an outlet for fluid communication with a space to be ventilated and jets directed into and adapted to supply a high velocity medium to the induction chamber in order to induce a flow of fresh air into and through the chamber from the inlet to the outlet. Accordingly, as disclosed in the British patent application, room air is not sucked into the induction chamber but ambient atmosphere, i.e. fresh air. This is (apart from the embodiment of FIG. 4) sucked into the induction chamber at a lower level than the level at which the mixed air is introduced into the room to be ventilated. It is neither disclosed in the British patent application that the mixed air is introduced by means of diffuse air supply into the room to be ventilated. On the contrary, the way of introducing the mixed air into the room in accordance with the British patent application, will lead to a substantial turbulence in the room to be ventilated, and this is also the purpose of the apparatus and the ventilation system disclosed in the British patent application, with particular reference to page 1, line 129 through page 2, line 10, thereof. Accordingly, it is clear from the British patent application that what is aimed at by the invention disclosed therein is to obtain a so called mixing ventilation which shots the disadvantages already described above and which will be further described herein.

DETAILED DESCRIPTION OF THE DRAWINGS AND OF THE BEST EMBODIMENT

Figure 1:
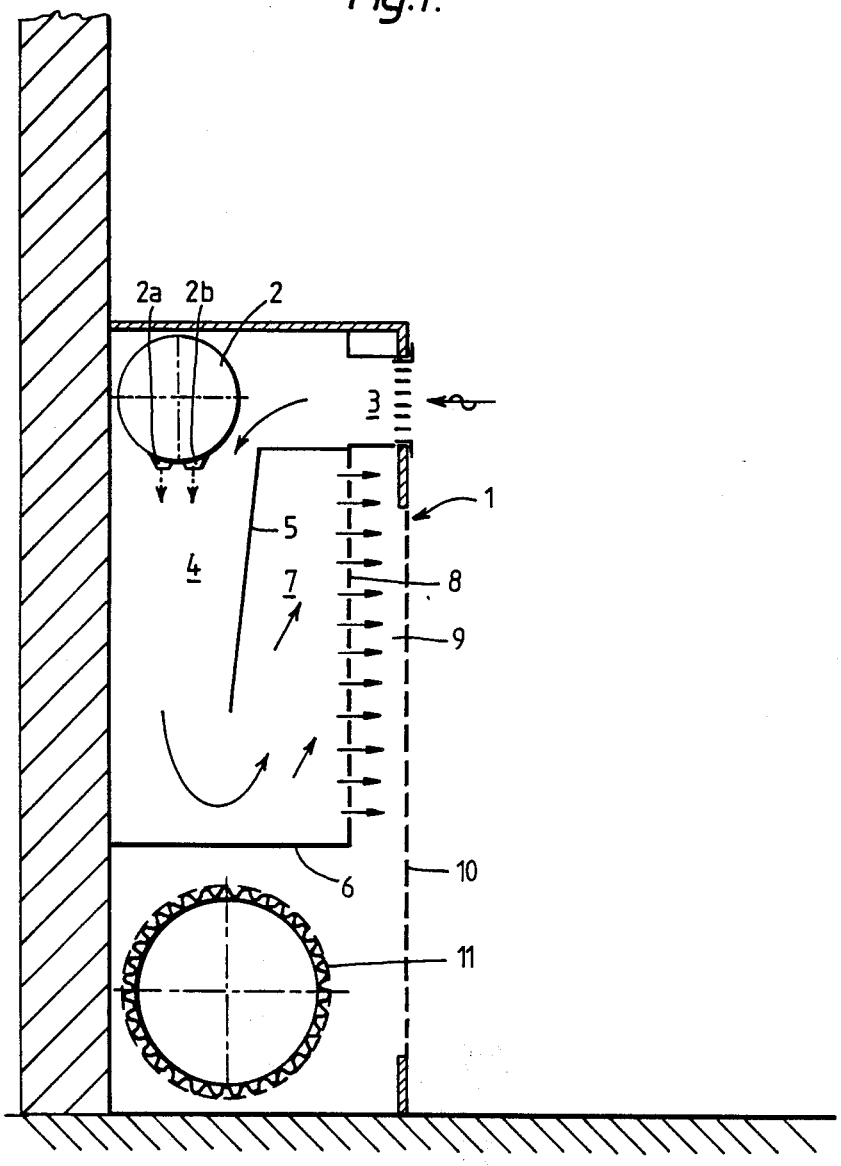
FIG. 1 shows an example of a device for introducing fresh air in admixture with circulated room air for ventilation of rooms based on the principle of diffuse air supply.

FIG. 1 shows a diffuser 1 arranged in contact with a wall of the room to be ventilated, and at floor level. Fresh air is introduced into a mixing chamber 4 from an isolated fresh air channel 11 by means of a fresh air supply means 2 which in the present case has been shown in the form of a tube provided with two nozzles *2a, 2b* which directs the air downwardly at high velocity into the mixing chamber 4 wherein the fresh air is mixed with room air which is introduced into the chamber 4, through a room air opening 3. In the mixing chamber 4, the fresh air and the room air are admixed and the mixed air flows downwardly towards a bottom plate 6 in the mixing chamber 4 and from there is diverted upwardly into a distribution chamber 7 which is defined by the bottom plate 6, a guiding plate 5 for the air stream and an air directing/air distributing means 8 consisting of an inner perforated plate which together with the geometrical form of the distribution chamber 7 as shown give a desired uniform distribution of the air across the perforated plate of the air directing/air distributing means 8 so that air will flow through the air directing/air distributing means 8 and into a pressure chamber 9 at essentially the same velocity across substantially the entire surface of the air directing/air distributing means 8 facing the pressure chamber 9. The air directing/air distributing means 8 also comprises lamellar means (not shown) which extend from the surface of the air directing/air distributing means 8 which faces the pressure chamber 9, in order to adjust the flow of air into the pressure chamber 9 so that the air will flow into the pressure chamber with an essentially horizontal velocity component. From the pressure chamber 9 the ventilation air flows through a perforated plate 10 into the room to be ventilated at an essentially uniform velocity across substantially the entire surface of the plate 10 which faces the room. The plates 5 and 10 and the perforated plate of the air directing/air distributing means 8 can be made of any material which is sufficiently self-supporting and which can tolerate contact with humid air, e.g. impregnated fiber boards or metal sheets.

Assuming that the relative temperature of the fresh air supplied when being introduced into the mixing chamber 4 is $t_1$, its relative degree of contamination $r_1$ and its volume flow $q_1$, that the relative temperature of the room air which is introduced at 3 is $t_2$, its relative degree of contamination $r_2$ and its volume flow $q_2$, and that the relative temperature of the air mixture introduced into the room through the plate 10 is $t_3$, its relative degree of contamination $r_3$ and its volume flow $q_3$, there being used a ratio of admixture n between the recirculated room air and fresh air $=q_2/q_1$, the following relations are obtained:

Volume flow of introduced mixed air $$q_3=q_1+q_2=(n+1)\cdot q_1$$

Relative temperature of introduced mixed air $$t_3=\frac{t_1+n\cdot t_2}{n+1}$$

Relative degree of contamination in introduced mixed air $$r_3=\frac{r_1+n\cdot r_2}{n+1}$$

If $$\frac{q_2}{q_1}=3$$

and and the relative temperature $t_1$ of the fresh air supplied is set equal to zero and if it is further assumed that the temperature difference between the relative temperature, $t_5$, at ceiling level of a room having a height of 3 m and the relative temperature, $t_1$, of the fresh air introduced is 14° C., then $\Delta t=t_5-t_1=14°$ C. When $t=0$ then $t_5=14°$ C. Consequently, $$t_3=\frac{t_1+3t_2}{1+n}=\frac{3t_2}{4}$$

A number of experiments carried out using known diffuse air supply have shown that beyond a short distance (about 20–30 cm) from the diffuser means into the room at floor level there is obtained at any point along the floor level a relative temperature, $t_4$, which is approximately equal to $$\frac{t_5-t_3}{2}+t_3,$$

see Norwegian VVS, No. 11, 1983, p. 862–885, the article by Mathisen and Skåret, and "The Efficiency of Ventilation Systems", SINTEF report N STF 81018.

$$\text{then } t_4=\frac{14-t_3}{2}+t_3=7+\frac{t_3}{2}$$

Because $$t_3=\frac{3t_2}{4}\text{, then } t_4=7+\frac{3t_2}{8}$$

Provided a rectilinear temperature gradient from floor to ceiling (height 3 m)

$$\text{then } t_2=t_4+\frac{1}{3}(t_5-t_4)$$

when the room air is taken from a level above floor level of about 1 m and admixed with the fresh air, i.e.

$$t_2 = \frac{2t_4}{3} + \frac{t_5}{3}. \text{ Because } t_5 = 14 \text{ and}$$

$$t_4 = 7 + \frac{3t_2}{8}, \text{ then}$$

$$\underline{t_2} = \frac{2}{3}\left[7 + \frac{3t_2}{8}\right] + \frac{14}{3} = \underline{12.4}$$

$$\underline{t_3} = \frac{3t_2}{4} = \underline{9.3}$$

$$\underline{t_4} = \frac{14 - t_3}{2} + t_3 = \underline{11.65}$$

$$\underline{t_5} = \underline{14}$$

The temperature gradient, $\alpha$, between floor and ceiling for a room height of 3 m then becomes $$\alpha = \frac{t_5 - t_4}{3} = \frac{14 - 11.65}{3} = 0{,}8^\circ \text{ C./}m$$

If an equally large amount of ventilation air had been introduced into the room only by means of supply of fresh air $$\text{then } t_3 = t_1$$

$$\text{i.e. } t_5 - t_1 = 14 (t_1 = 0)$$

$$\text{and } t_4 = \frac{t_5 - t_1}{2} = \frac{14}{2} = 7.0$$

Temperature gradient, $\alpha$, will then be $$\frac{t_5 - t_4}{3} = \frac{14{,}0 - 7{,}0}{3} \approx 2.3^\circ \text{ C./}m$$

Figure 2:
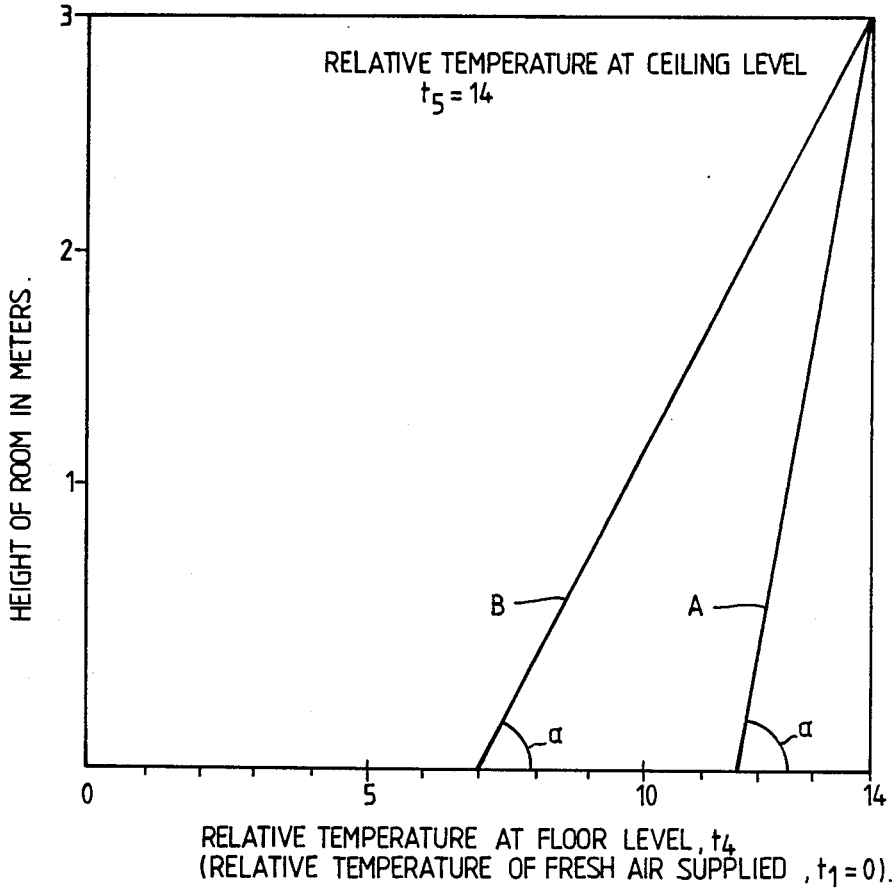
FIG. 2 depicts diagrammatically the relative temperature distribution at various levels in a room when using a ventilation method according to the present invention (curve A) and when using a ventilation method based upon conventional diffuse air supply with introduction of fresh air only (curve B)

The relations explained above have been graphically depicted in FIG. 2. The relative temperature at ceiling level, $t_5$, is 14.0, and the relative temperature of the fresh air supplied, $t_1$, is 0. The height of the room in meter has been plotted along the ordinate of the diagram, and relative temperature at floor level, $t_4$, has been plotted along the abscissa of the diagram. The curve A shows the course of the temperature gradient when ventilating the room in agreement with the present method and in agreement with the above example whereas the curve B shows the course of the temperature gradient from floor to ceiling using conventional diffuse air supply with introduction of fresh air only. The amount of ventilation air introduced is the same in both cases. It appears from curve A that the requirement to a maximum temperature difference between feet and head not above 3° C. for sitting persons is easily satisfied whereas the temperature gradient according to curve B strongly approaches this maximum permissible temperature difference.

If the relative contamination in a room which is ventilated by means of conventional diffuse air supply and by means of the present method with room air introduced into the ventilation air respectively is considered with basis in the equation stated above for the relative concentration of contaminants in the ventilation air, $r_3$, for an introduced amount of ventilation air of 4 volume units, i.e. $n+1=4$, wherein $n=3$, i.e. the number of volume units of room air mixed into the ventilation air, i.e.

$$r_3 = \frac{r_1 + n \cdot r_2}{n + 1} = \frac{r_1 + 3r_2}{4}$$

then, provided that the relative concentration of contaminants in the fresh air $r_1$ is set equal to 0, $$r_3 = \frac{3r_2}{4}$$

Assuming that the relative concentration of contaminants in the room air, $r_2$, mixed with the fresh air is 10, there is obtained a relative concentration of contaminants in the ventilation air introduced, $r_3$, of 7.5. Further assuming that the relative concentration of contaminants in the room air mixed with the fresh air is 15, there is obtained a relative concentration of contaminants in the ventilation air introduced, $r_3$, of 11. Further, at a relative concentration of contaminants in the room air, $r_2$, mixed with the fresh air of 20 there is obtained a relative concentration of contaminants in the ventilation air introduced, $r_3$, of 15.

Figure 3:
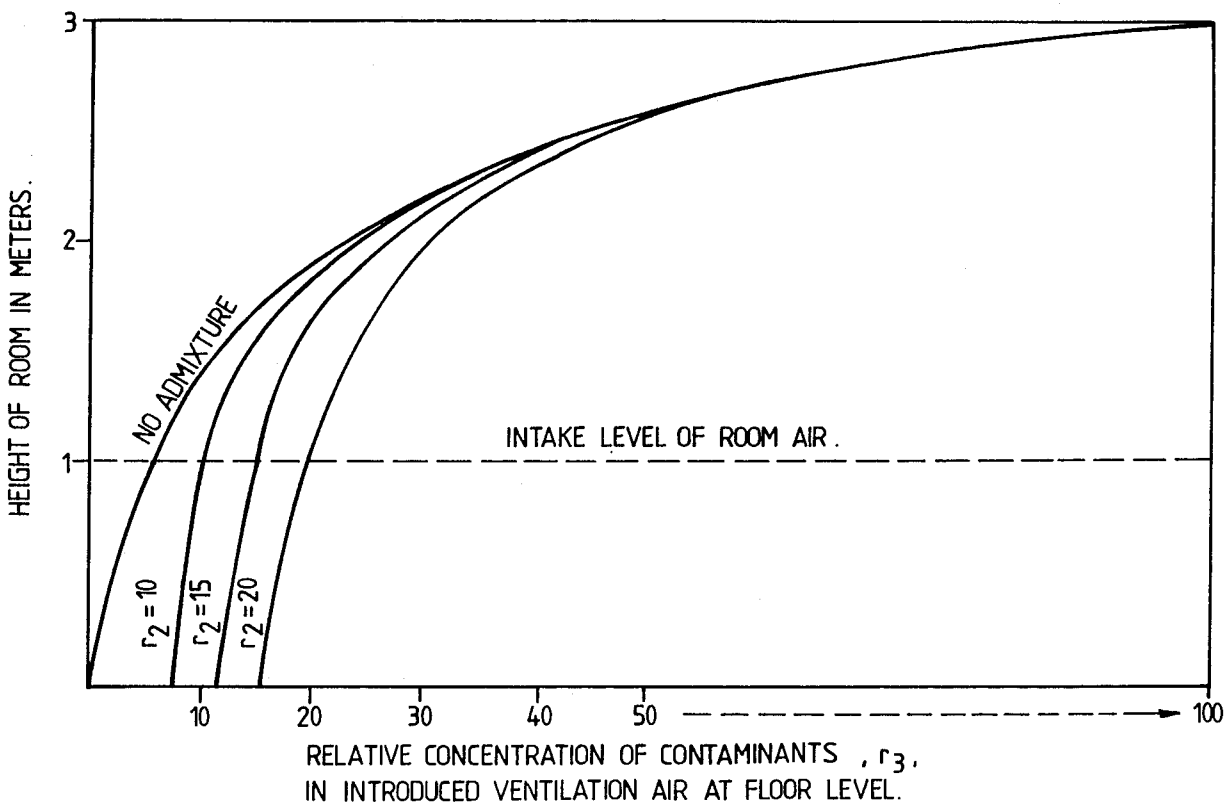
FIG. 3 depicts diagrammatically the distribution of the relative concentration of contaminants at various levels in the room when using the method of ventilation according to the present invention.

This relationship has been graphically depicted in FIG. 3, with the height of the room of 3 m again being plotted along the ordinate, however, with the relative concentration of contaminants in the ventilation air introduced being plotted along the abscissa. The relative concentration of contaminants at ceiling level has been set equal to 100. The diagram shows how the relative concentration of contaminants will be approximately distributed over the height of the room from floor level to ceiling level for the three mentioned cases with a relative concentration of contaminants in the room air mixed with the fresh air of 10,15 and 20 respectively, and, further, how the relative concentration of contaminants over the height of the room will be distributed upon supply of the same volume amount of fresh air, without mixing with room air, with the proviso that the relative concentration of contaminants in the fresh air supplied has been set equal to zero.

Even though by means of the present method, impure room air is mixed with the fresh air supplied in order to provide the flow of ventilation air, there is obtained a low relative concentration of contaminants up to the levels which normally are of importance to persons occupying the room. In addition, there is obtained a very significant temperature advantage.

A further development of the above disclosed calculations will show that at induction ratios beyond 3:1 ($n=3$) relative small effects are obtained with respect to the relative concentration of contaminants and the relative temperature conditions in the room. Moreover, higher induction ratios demand higher apparatus costs. If the induction ratio is lowered, the temperature of the air supplied must be increased because a too low temperature along the floor is not permissible and, accordingly, it is not recommendable to use a lower induction ratio than 1:1. Accordingly, it can be maintained that an induction ratio within the range from 1:1 to 3:1 is the range within which it should be operated, however, the induction ratio which ought to be used in a given case will of course be dependent upon a number of variables, of which the temperature difference between the temperature of the room air at ceiling level and the temperature of the fresh air will be of the utmost importance. If this temperature difference is low, then of course the induction ratio used may be kept correspondingly low, whereas if this temperature difference is large, the induction ratio used must be kept high. However, introduction of large amounts of fresh air in order to obtain the desired ventilation will, as mentioned, be conducive to increased apparatus costs.

The lower relatively pure zone in the room from which room air is drawn into the device or the devices for the diffuse air supply may under normal conditions have a height of up to 1.5 meter from floor level, however, in conventional practice room air will normally not be drawn into the diffuser devices from a level higher than about 1 m, preferably not higher than about 60 cm, above the floor. With reference to the diffuser device shown in FIG. 1, it may informed that this advantageously may have a height up to 65 cm from floor level, a depth from the adjacent wall and into the room of up to 30 cm, preferably not above 25 cm, and a width along the wall of up to 100 cm. Of course, these dimensions may vary depending upon the size of the room and whether or not several diffuser devices are used therein.

I claim:

1. A method of ventilating a room, wherein one or several jets of fresh air (*2a, 2b*) at high velocity is blown into an induction chamber (4) sucking in surrounding air (3) into the induction chamber and mixing the surrounding air and the fresh air in the induction chamber, and introducing the mixed air from the induction chamber (4) essentially horizontally into the room to be ventilated characterized in that into the induction chamber (4) surrounding air is sucked in which consists of room air (3) taken from a higher level in the room to be ventilated then the level at which the mixed air is introduced into the room, the level at which the room air is sucked into the induction chamber (4) being no higher than $\frac{1}{3}$ of the higher of the room from floor to ceiling, the mixed air being introduced into the room by means of diffuse air supply at or near floor level, and the room air being exhausted from the ventilated room at or near ceiling level.

2. A method as claimed in claim 1, characterized in that there is used a ratio by volume between room air for the diffuse air supply and fresh air for the diffuse air supply of from 1:1 to 3:1.

3. A method of ventilating a room having a floor and a ceiling located a preset height above the floor, the method comprising the steps of:

conducting at least a first jet of fresh air at a high velocity into an induction chamber;

drawing air into the induction chamber from the room at an input level, said input level being above the floor and no higher above the floor than $\frac{1}{3}$ if the preset height;

mixing the fresh air and the room air in the induction chamber to produce a supply of mixed air;

conducting the mixed air from the induction chamber essentially horizontally into the room, by means of a diffuse air supply, said mixed air being conducted into the room at a level below the input level and at or near the level of the floor; and exhausting air from the room at or near the level of the ceiling.

4. A method according to claim 3, wherein the input level is less than one meter above the level of the floor.

5. A method according to claim 4, wherein the input level is less than sixty-five centimeters above the level of the floor.

6. A method according to claim 4, wherein:

the room air is conducted into the induction chamber at a first rate;

the fresh air is conducted into the induction chamber at a second rate;

the ratio of the first rate to the second rate is from 1:1 to 3:1.

7. A method according to claim 6, wherein the step of drawing the air into the induction chamber includes the step of drawing the air into the induction chamber through a room air opening located directly above the diffuse air supply.

* * * * *

UNITED STATES PATENT AND TRADEMARK OFFICE

CERTIFICATE OF CORRECTION

PATENT NO. : 4,711,162

DATED : December 8, 1987

INVENTOR(S) : Mats Eriksson

It is certified that error appears in the above-identified patent and that said Letters Patent is hereby corrected as shown below:

Column 4, line 7: "aporoximate" should read as --approximate--

Column 7, line 3: "shots" should read as --shows--

Col. 8, line 55, "Because $+_5$ = 14" should read --Because $t_5$ = 14--

Column 11, Claim 1, line 40: "higher" should read as --height--

Column 12, Claim 3, line 14: "1/3 if the present" should read as --1/3 of the present--

Signed and Sealed this

Twenty-sixth Day of July, 1988

*Attest:*

DONALD J. QUIGG

*Attesting Officer*

*Commissioner of Patents and Trademarks*